United States Patent [19]

Delaporte

[11] 4,122,892

[45] Oct. 31, 1978

[54] DEVICES FOR HEATING PREMISES BY THE USE OF HEAT PUMPS AND METHOD THEREFOR

[75] Inventor: Jean-Charlemagne Delaporte, Saint Bruno de Montarville, Canada

[73] Assignee: S.A. dite Compagnie Generale de Chauffe, Saint Andre, France

[21] Appl. No.: 730,454

[22] Filed: Oct. 7, 1976

[30] Foreign Application Priority Data

Oct. 16, 1975 [FR] France ..... 75 32232

[51] Int. Cl.[2] ..... F25D 21/12

[52] U.S. Cl. ..... 165/12; 62/199; 62/282; 165/97

[58] Field of Search ..... 62/238, 82, 199, 200, 62/282; 237/2 B; 165/97

[56] References Cited

U.S. PATENT DOCUMENTS

| | | | |
|---|---|---|---|
| 1,785,334 | 12/1930 | Black | 165/97 |
| 2,763,132 | 9/1956 | Jue | 62/200 X |

*Primary Examiner*—William E. Wayner

*Attorney, Agent, or Firm*—Martin A. Farber

[57] ABSTRACT

Two evaporators are alternately fed with freon with subsequent timed reversal of the air flow thereabout so as to eliminate trouble resulting from coil-icing and to further increase the heat recovery of building heating systems.

10 Claims, 4 Drawing Figures

DEVICES FOR HEATING PREMISES BY THE USE OF HEAT PUMPS AND METHOD THEREFOR

The present invention concerns improvements in or relating to devices for heating premises by the use of heat pumps, recovering heat in the air extracted from the premises and transferring it to a fluid thereby ensuring heating.

It is mainly in collective dwellings that a technique, under the name of "Controlled and Mechanical Ventilation", for the extraction of air from so-called secondary rooms (kitchens, toilets, bathrooms) has been developed. This method makes it possible to provide houses with a fresh supply of air obtained from a controlled supply and in a controlled direction of ventilation. This extraction device is even sometimes supplemented by a second blower system, propelling fresh pretreated air into the so-called principal rooms (living room, bedrooms).

Since heat losses due to the supply of fresh air represent an important item in the total energy balance of a house, attempts have been made to reduce these losses by recovering the maximum heat contained in the extracted air and rejected by controlled mechanical ventilation.

A first type of recovery device used for this purpose is constituted by stationary or movable exchangers functioning between the extracted air and the external air which is thus pre-heated before being blown into the house. Exchange yields obtained are generally very satisfactory, but the recovery of heat can, of course, have an effect only on the difference between the temperature of the extracted air (of the order of 20° C) and that of the external air, that is to say, a rather small difference in spring or autumn. Moreover, since the temperature of external air may drop below 0° C, a problem of frost arises which is solved only by pre-heating this air to the temperature above 0° C.

A second type of device employed has recourse to heat pumps, the evaporator taking, either directly by direct release into the evaporator located in the extracted air circuit, or indirectly, by means of an iced water circuit, glycolated or not, the heat contained in the air extracted from the house, and this heat is then transferred, intensified by the mechanical energy of the compressor, to the condenser from where it is returned to the house either directly, by reheating the blown air passing over the condenser or indirectly by production of hot water, and used then for heating the blown air or for feeding a basic heating circuit.

This second type makes it possible to go beyond a simple recovery of heat, since in spring and autumn in particular, it is posible to reject air extracted at a temperature lower than that of the external air. Nevertheless, the problems of frost on the evaporator, which are particularly serious, due to the fact that the air extracted from a house is even more heavily charged with moisture than the external air, because of additinal internal moisture, make it impossible to propose cooling this air below a temperature of the order of 3° - 5° C.

However, frost on the evaporator of a thermodynamic machine consistutes a constant problem for which numerous remedies have been sought and proposed, Solutions adopted sometimes employ auxiliary energy (electricity in general), but also an active circulation of hot air or sprinkling with water) ensuring the perodic melting of the ice. In other cases it is necessary to stop the apparatus or even to reverse the refrigerating circuit, the evaporator acting as a provisional condenser. Most of the solutions are however based on the so-called "hot-gas" technique in which hot refrigerating gas is used compressed by the compressor for periodically reheating the evaporator and ensuring defrosting thereof, and for which numerous devices or variants have been proposed. These solutions necessitate stoppages or interruption to the operation of the machine, and these are incompatible with the necessity of continuously supplying a heating fluid for the regular heating of the premises.

According to the present invention there is provided an improved device for heating premises utilising a heat pump, wherein the evaporator of which is intended to cool expelled air which has been taken from the premises at a temperature higher than 0° C and wherein the condenser of which reheats a fluid used for heating, and is periodically defrosted, in which the energy recovered from the air extracted from premises by means of at least two evaporators located in series is transferred to a separate heating fluid, the evaporators being continually traversed by a current of air and capable of being operated in cycles with correlative diversion of the current of air to be cooled in such manner that each frosted evaporator concerned is, simultaneously with the diversion of the current of air put momentarily and completely out of service with regard to its circulation of refrigerating fluid, while initially the air taken from the premises, i.e. at more than 0° C, is directed at the evaporator, the air being cooled and expelled, until the moment when the evaporator is completely defrosted, the residual water resulting from this defrosting operation and also resulting from an initial lowering of the temperature of this air, being eliminated while another evaporator refrigerates the air to be cooled and expelled, to a temperature lower than normal so that it becomes frosted, the changing of the circulation of air to be cooled and expelled and of the circulation of refrigerating fluid being effected as soon as the evaporator in service has become covered with frost to bring into service an evaporator which has been defrosted, and so on, all the operations being effected without interruption or other reversal in the operation of the refrigerating machine or in the circulation of the heating fluids or in the intake of air to be expelled and aspirated, and also without any effect on the temperature of the heating fluid, and the defrosting being obtained from the heat alone contained in the expelled air.

In order to simplify matters, two identical evaporators are usually employed. Such have proved to be satisfactory, and devices for reversing the flow of air are provided, operating in conjunction with gate valves for cutting out the circulation of refrigerating fluid. These devices reversing the flow of air are simultaneously of the swing flap type or cylindrical faucet pipe registers with orifices or apertures.

According to a preferred embodiment, the defrosting cycle is controlled so that the change of feed with refrigerating fluid released by the evaporators is effected synchronously, i.e. slightly advanced in time or retarded or simultaneously with a reversal of the direction of the flow of reheated air onto the two evaporators.

The defrosting cycle may be controlled at intervals of time given by a timing mechanism or by a measurement of physical size associated with the condition of frosting of the evaporator fed with released refrigerating fluid.

If it is desired to heat the premises with pulsed air, such air will be heated by fluid over at least one condenser of the aforementioned refrigerating circuit, then distributed in a system having the usual regulating means of such installations.

If it is desired to heat the premises with a conventional low temperature heating installation such as floor heating or a conventional radiator heating installation, the heat-carrying liquid is heated by flowing in at least one condenser of the aforementioned refrigerating circuit.

Several conduits of the apparatus may be provided according to the requirements of the users. In certain cases the controls for operation and adaptation of the power consumed by the compressor are effected so as to deliver a heating fluid at a constant temperature at the outlet of the condenser. In other cases, they are effected so as to deliver at the outlet of the condenser a heating fluid at a temperature varying according to a predetermined law as a function of the external temperature, due to the action of a programmer in the manner which is usual in installations programmed in a similar manner.

The device of the present invention may be designed so as to ensure by itself only the heating of the premises to be served, this being due to the possibility of taking from the extracted air large quantities of heat, since it is possible to considerably reduce the temperature of the expelled air. However, an installation may be provided just sufficient for heating under normal conditions of external temperature, but an adjustment is provied for the temperature of the premises by combination with a suitable heating device controlled by the user employing a different energy source which may be of any type. However, it is convenient, in this case, to use electricity. In the latter case an installation may be provided operating under the best conditions possible, since it will always operate with maximum yield, i.e. in the range of optimum operation for which it has been provided.

The present invention wll be more clearly understood by means of the following description illustrating embodiments thereof which are given by way of example only and are not of a limiting character. For example, the use of many different embodiments capable of ensuring the same functions will still be within the scope of the present invention. The invention is illustrated in the accompanying drawings, in which.

Figure 3:
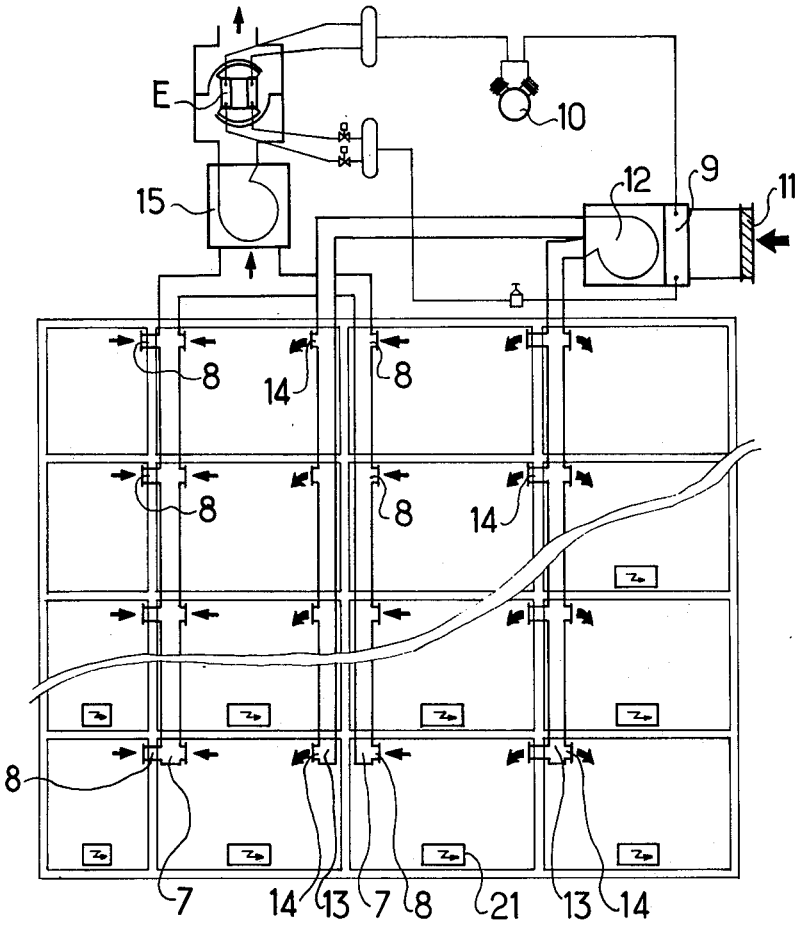
Figure 4:
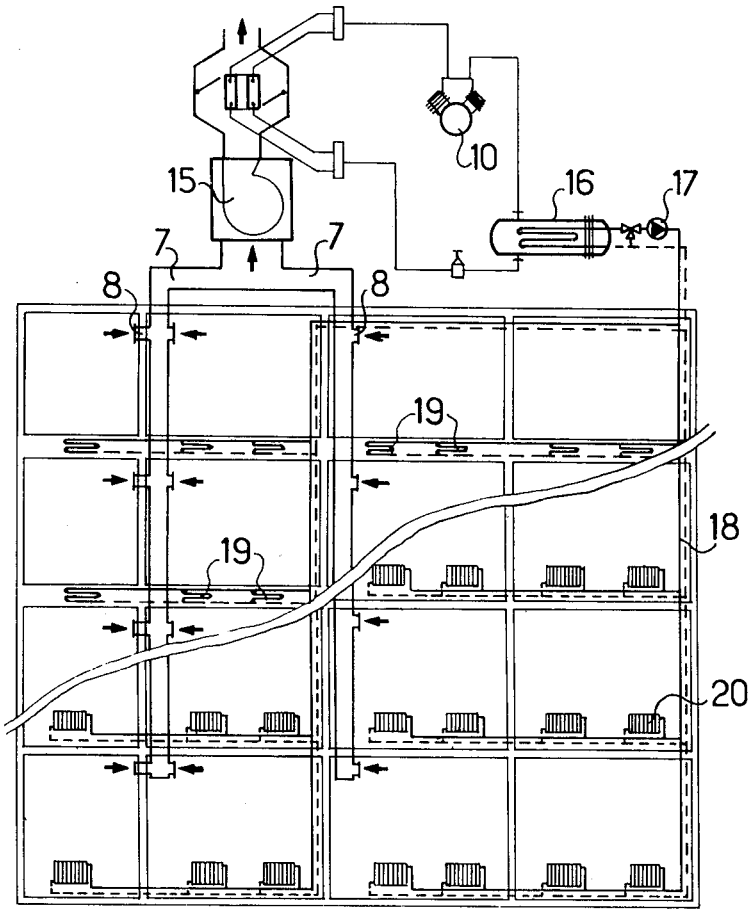

FIG. 3 is a schematic diagram showing the installation of the device of the present invention for heating a house, in which an installation is shown in the upper part of the Figure, where the device of the present invention is sufficient for heating the house by itself, while the lower part of FIG. 3 shows a version in which, in addition, a suitable means of heating by electricity is provided; and FIG. 4 is a schematic diagram showing installation of the device of the present invention for heating a house by a heat-carrying fluid with intake of stale, foul or bad air, in which diagram, only for example in the upper part of the Figure, a floor heating installation is shown and, in the lower part of the Figure, a heating installation by conventional radiators is shown.

Figure 1:
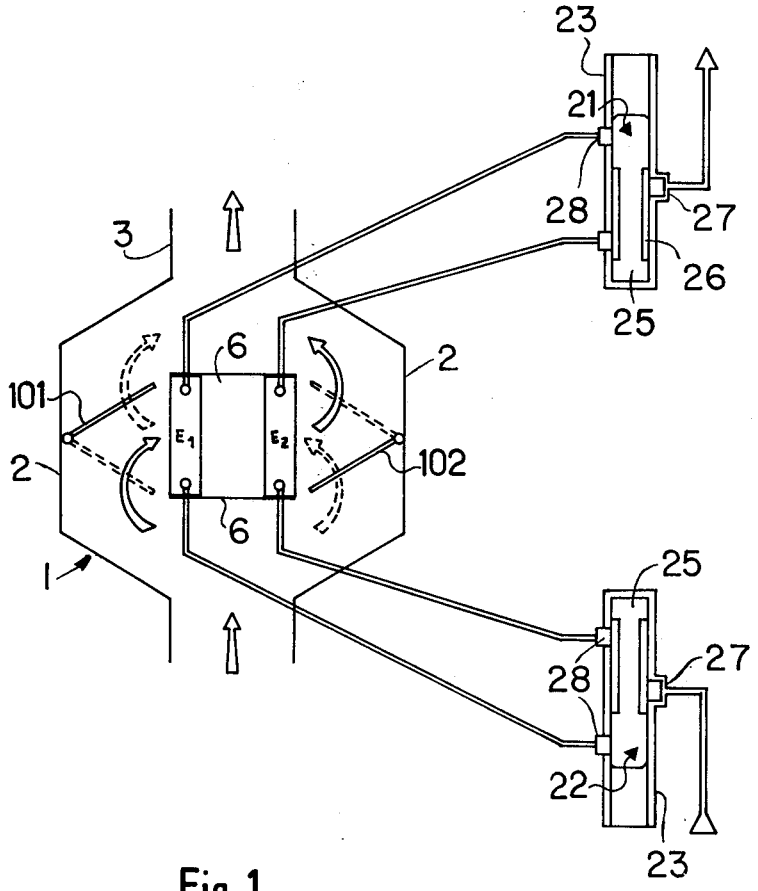
FIG. 1 is a schematic view of a first embodiment of a device for reversing the flow of air between the evaporators.
Figure 2:
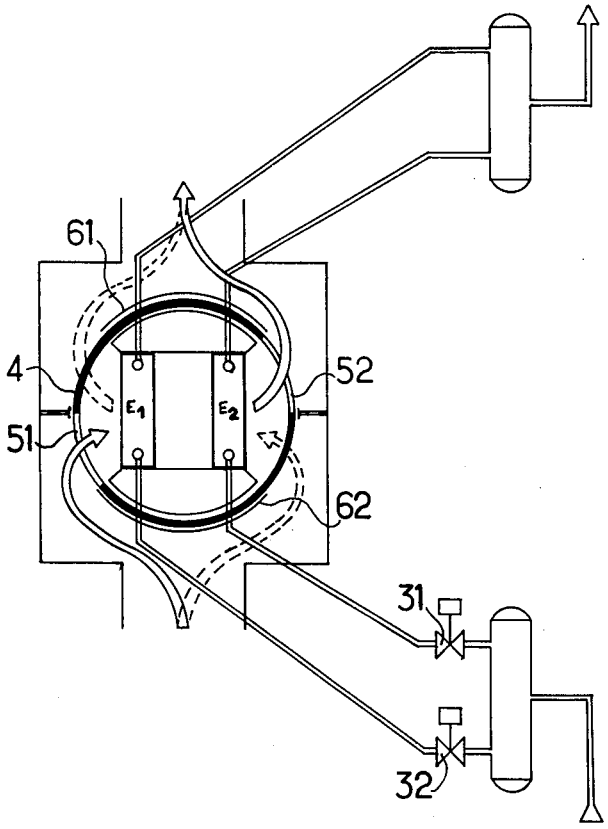
FIG. 2 is a schematic view of a second embodiment of the device for reversing the flow of air between the evaporators, by cylindrical faucet pipes.

In the device according to the present invention (FIGS. 1 and 2), the evaporator $E_1$ of the heating pump is supplemented by a second identical evaporator $E_2$. Both evaporators are located in the circuit of air extracted from the house, and are travered in succession ($E_1$ then $E_2$ for example) by the air supply, but only the second evaporator traversed, $E_2$, being fed with released refrigeration fluid. After a certain time, the evaporator $E_2$ begins to become covered with frost, the direction of the flow of air is reversed, i.e. $E_2$ towards $E_1$, and simultaneously or synchronously, the feed of released refrigerating fluid is changed, $E_1$ only being fed and "active". This change in the feeding of the two evaporators may be obtained by means of a distributing slide valve (reference numerals 21, 22 in FIG. 1) or by means of two electric gate valves (reference numerals 31, 32 in FIG. 2) opening and closing alternately. The reversal in the direction of flow of air may be obtained by the simultaneous swinging of two air flaps (reference numerals 101, 102 in FIG. 1) or by the rotation of a faucet pipe (reference numeral 4 in FIG. 2) uncovering two apertures (reference numerals 51, 52) and by masking two others (reference numeral 61, 62). The two embodiments described above and shown in FIGS. 1 and 2 are given by way of example. Many different embodiments, capable of fulfilling the same operations (simultaneous opening and closing of registers etc). can be used. The evaporators $E_1$ and $E_2$ are connected in parallel inside an octagonal air conduit 1 parallel to opposite sides 2 thereof. The swinging air flap valves 101 and 102 respectively, are pivotally connected to the center of the opposite walls 2 and extend to adjacent the corresponding evaporator. As illustrated in FIG. 4 the fan 15 which withdraws used air from the heated premises is centrally connected to the octagonal air conduit in alignment with the parallel evaporators. Baffle plates 6 are connected to and between corresponding ends of the evaporators to prevent air from passing therebetween. Only the flap valves 101 and 102 direct the air sequentially through the evaporators as indicated by the solid and dashed arrows, respectively. An exhaust air opening 3 communicates centrally with the conduit 1 aligned with the inlet from the fan on the opposite side. Both corresponding ends of the evaporators are connected to the respective refrigeration distributing slide valves 21, 22, respectively, at refrigeration fluid connections 28, the latter of each slide valve being axially spaced apart on the tubular body 23 of the slide valve. A piston 25 is displacably disposed in the tubular body 13 of each slide valve and is formed with an annular recess 26 having a length smaller than the distance between the refrigeration fluid connections 28 of the respective evaporators. A common connection 27 is provided in the tubular body 23, between the connections 28, which communicates operatively with the condenser 16 (FIG. 4), so that in one position of the pistons 25 only one evaporator (e.g., $E_2$ in FIG. 1) is communicated with the connections 27 of the condensor via the annular recess 26 and flow of refrigeration fluid is stopped through the other evaporator.

As a result of the interchange, the evaporator $E_2$, which no longer is being fed, is from now on traversed by the flow of air extracted from the house and the ice covering it begins to melt, by extracting a small portion of the appreciable and latent heat contained in this air, the warmth of which is then very considerably reduced during its passage through the evaporator $E_1$ which is fed with released refrigerating fluid.

Naturally, as soon as evaporator $E_1$ begins to become frosted in its turn, the direction of the flow of air is reversed again and an interchange in the feeding of the evaporators with released refrigerating fluid is effected thus returning to the initial position.

A tank located below each of the two evaporators receives the condensates and frost water and evacuates them by gravity, for example.

It will be noted that during the entire cycle, the flow of extracted air has not stopped passing through an "active" evaporator and that there has not been therefore any interruption in the supply of heat to the condenser.

As shown schematically in FIGS. 3 and 4, the heat recovered by the "active" evaporator from the air of the house by the fan 15 through the extraction apertures 8 and the conduit 7 is transferred to the condenser of the heat pump, and intensified by the energy absorbed by the compressor 10. The fan 15 is located upstream of the assembly of the two evaporators so as also to be able to recover some of the energy which it consumes to ensure this extraction of air.

The energy is transmitted to any type of heating fluid, all types of conventional central heating installations being capable of being served; either:

1. Installations heated by hot air (top part of FIG. 3), the hot air being constituted by the external air, previously filtered through a filter 11, reheated by flowing through an air condenser 9 relative to the refrigerating circuit, also consistuted by the evaporators E and the compressor 10, then propelled by a fan 12 through distribution conduits 13 and blown into the premises to be heated through blast apertures 14; or 2. Installations heated by hot water (FIG. 4), in which the water returned from the installations is reheated in a water condenser 16, then propelled by a pump 17 into distribution conduits 18 as far as heating bodies which may be any hydronic heating system, only for example but not limited thereto, be floor heating panels 19 if low temperature hot water is produced (the case at the top of FIG. 4) or radiators 20 if it is produced at an average or mean temperature (the case at the bottom of FIG. 4).

The control for operating the heat pump and the automatic adaptation of the power consumed by the compressor 10 for heating the house may be achieved in accordance with any of the systems already existing on these devices, so as to supply at the outlet of the condenser 9, a heating fluid at a constant temperature associated, if desired, with an airstat, located in the hot air conduit 13 at the outlet of the condenser 9 or with an aquastat located in the hot water pipe 18 at the outlet of the condenser 16. In this case, the heating installation served should comprise its own regulating devices operating according to the external temperature so as to ensure a regular temperature in the heated premises. This arrangement is particularly adapted to complex installations, comprising a plurality of separate circuits serving parts of the premises having different needs.

In the case in which the served installation is simple and comprises only one circuit, or circuits serving premises having similar heat requirements, this control for the operation and automatic adjustment of the power consumed by the compressor may be achieved, in accordance with any of the systems already existing on these devices, so as to supply at the output of the condenser, a heating fluid of variable temperature, measured if desired by an airstat located in the hot air conduit 13 at the output of the condenser 9 or by an aquastat located in the hot water pipe 18 at the output of the condenser 16 and adjusted by a programmer which may be of any known type, the object of which is to supply an emission point varying according to a predetermined law as a function of the external temperature.

The triggering of the reversing of the direction of flow of air extracted from the premises through two evaporators, and of the interchange of the feed of refrigerating fluid released from these two evaporators, may be controlled by a timing mechanism at predetermined intervals. This timing mechanism is preferably adjustable, so as to be able to adjust the duration of each cycle according to the degree of relative humidity of the air. This control may also be obtained from a measurement characteristic of the frosted condition of the evaporator in service (pressostat for the pressure of the evaporator thermostat for the temperature of the cooled air, etc.).

In the foregoing description, an installation has been described, comprising only one refrigerating group. It is obvious that, as a function of the total thermal power employed the installation may comprise a plurality of compressors, making it possible to fractionate the power used, or a single compressor having a plurality of cylinders. Moreover, it is also clear that the system may be employed with all types of existing refrigerating devices, by selecting the refrigerating fluid best adapted to conditions of service, and in particular to the temperature which must be obtained in the condenser as a function of the type of heating installation connected.

The main advantage of the system according to the present invention results from the possibility it provides for expelling air extracted from the premises at very low temperatures, while existing systems simply permit this air to be returned at a temperature slightly higher than that of the external air, and/or, at the best, at a temperature slightly higher than 0° C. This is what enables the present invention to represent per se a method of heating requiring for all its energy only the electric energy consumed by the compressor and the fans, with the single reservation that the part of heat losses due to renewing the air is sufficiently important in the total heating balance of the premises, to make it worth while to avoid having to expel the air extracted at very low temperatures and to operate the thermodynamic device with a very low co-efficient of performance. This portion is already considerable and can only increase in the future with the continuous improvement of thermal installation in newly constructed buildings.

However, it is desirable to use the device of the present invention only to ensure basic heating to enable the power of the installed heat pump to be reduced and to permit greater flexibility of operation in spring and autumn. The suitable method of heating employed should preferably be adjustable at each point of emission, as is the case for electric convectors 21, (bottom of FIG. 3), or radiators fitted with a thermostatic valve (bottom of FIG. 4) for example, so as to permit an adjustment of the temperature in each of the rooms served and specific heat consumption individualised at the level of each of the users.

It is obvious that, although the description of the device of the present invention has been presented for its application to the heating of dwelling premises, it is still within the scope of the present invention for it to be applied to other types of premises.

It should also be noted that the defrosting device employed in the heating system of premises according to the present invention may also be employed on any refrigerating machine used for any other use, with the single reservation that there is a possibility of circulating through the two evaporators, air at a temperature at least slightly above 0° C.

The system according to the present invention resides in the use of a heat pump, the evaporator of which is designed to obtain this defrosting process without having recourse to any auxiliary energy or interruption or reversals of its operation.

What I claim is:

1. An improved device for and in combination with heating premises utilizing a heat pump, comprising premises to be heated, at least two evaporators mounted adjacent the premises and having refrigeration fluid circulating therethrough when activated, respectively, means for continuously directing air withdrawn from the premises at a temperature higher than 0° C onto both of said evaporators in sequence one after the other for cooling the air, said two evaporators being arranged in series with respect to the flow of the air and recovering heat energy from the air withdrawn from the premises, said means including means for reversing the sequence of the flow of the air onto said evaporators, a separate heating fluid means for heating the premises, condenser means operatively connected to said evaporators in communication with the refrigeration fluid for reheating the separate heating fluid means used for heating the premises by the recovered heat from the air being transferred to the heating fluid means via the refrigeration fluid, means for operating each of said evaporators in cycles one at a time while the other of said evaporators is inactivated, and with reversal of the sequence of the flow of the air onto said evaporators for simultaneously effecting a reversal in the operative and inactivated conditions of said evaporators, respectively, such that said first-mentioned operative evaporator simultaneously with the reversal of the sequence of flow of the air is momentarily and completely inactivated totally stopping circulation of refrigeration fluid therethrough and activating said other evaporator, initially with the air withdrawn from the premises being directed first onto one of said evaporators and in sequence then onto another of said evaporators, while said one evaporator is inactivated with no refrigeration fluid therethrough and said another evaporator is activated with circulation of the refrigeration fluid therethrough, with the air defrosting said one evaporator and being cooled and expelled at a temperature lower than normal such that said another evaporator becomes frosted, such that the reversing of the activated and inactivated conditions of said evaporators, respectively, as well as the reversing of the sequence of the flow of air to be cooled and expelled being effected as soon as the activated said another evaporator becomes covered with frost and said one evaporator is defrosted, thereupon reversing the sequence of the air flow, inactivating said another evaporator totally stopping the circulation of refrigeration fluid therethrough and activating said one evaporator, and so on cyclically, all reversals and operational conditions being effected continuously without interruption without other change in the operation of the refrigeration, in the heating fluids and in intake of the air, and also without any effect on the temperature of the heating fluid means, the defrosting of the inactivated evaporator being effected by the heat alone contained in the air withdrawn from the premises, ensuring per se only the heating of the premises due to removal of considerable quantities of heat from the air, by considerably lowering its temperature, said means for reversing the sequence of the flow of air completely over each of the evaporators constitute swinging flap valves adjacent each of said evaporators, said reversing means for simultaneously swinging said flap valves in opposed directions up to opposite respective ends of the evaporators, so as to allow the air to completely pass over the evaporators in respective sequence.

2. The device for heating premises, as claimed in claim 1, wherein said at least two evaporators are identical evaporators, said means for reversing the sequence of the flow of air operates cooperatively with said means for operating said evaporators for cyclically totally stopping and starting the circulation of the refrigeration fluid through said evaporators, respectively.

3. The device for heating premises as claimed in claim 1, further including means for controlling defrosting cycles such that the change of activation of said two evaporators one at a time with a feed with refrigeration fluid therethrough, respectively, is synchronous with a reversal of the direction of the sequence of the flow of air onto said two evaporators.

4. The device for heating premises as claimed in claim 3, wherein said controlling means constitutes a timing mechanism for controlling at predetermined time intervals.

5. The device for heating premises as claimed in claim 3, wherein said controlling means is for controlling the defrosting cycle by measurement of a physical characteristic of the frost condition of the then operative of said evaporators being fed with the refrigeration fluid.

6. The device for heating premises as claimed in claim 4, wherein the heating fluid is a heat-carrying liquid which is heated by flowing in said condenser means in heat-exchange relationship with said refrigeration fluid and is adapted to be pulsed and used for feeding a conventional low temperature heating installation.

7. The device for heating premises, as claimed in claim 1, further comprising a compressor operatively connected between said evaporators and said condenser means, means for operation and adaption of the power consumed by said compressor and further for supplying the heating fluid at a constant temperature at an outlet of said condenser means.

8. The device for heating premises, as claimed in claim 1, further comprising a compressor operatively connected between said evaporators and said condenser means, and means for operation and adaptation of the power consumed by said compressor further for supplying the heating fluid means at an outlet of said condenser means with a temperature varying according to a predetermined function of the external temperature.

9. The device for heating premises, as claimed in claim 1, further comprising means for adjusting the temperature of the premises by combination of the device with a heating device controlled by the user employing an external source of electricity.

10. The device for heating premises, as claimed in claim 1, further comprising an octagonal air conduit, said two evaporators are mounted in parallel in said octagonal air conduit parallel to opposite walls thereof, each of said swinging flap valves are mounted at one end thereof pivotally on the center of the opposite walls, respectively, and extends to adjacent said evaporators, respectively, a baffle plate disposed across the ends of said evaporators and therebetween, respectively, a fan connected to said premises and to said air conduit centrally aligned with said evaporators, said air conduit has an exhaust air opening centrally aligned with said evaporators on a side opposite to said fan, a first refrigeration fluid distributing slide valve having axially spaced connections connected to one of the ends of each of said two evaporators, respectively, a second refrigeration fluid distributing slide valve having axially spaced connections connected to the other of the ends of each of said two evaporators, respectively, said distributing slide valves each comprises: a tubular body connected at said spaced connections to said two evaporators, respectively; a piston slidably disposed in said tubular body; and a common connection, operatively in communication with said condensor means, connected to said tubular body between said axially spaced connections, said piston is formed with a central annular recess communicating simultaneously with only one of said axially spaced connections and said common connection in one slided position of said piston in said tubular body, and respectively, with only the other of said axially spaced connections and said common connection in another slided position of said piston in said tubular body, said pistons of both of said slide valves being simultaneously operated cyclically to totally stop flow of the refrigeration fluid through one of said evaporators and to pass the refrigeration fluid through the other of said evaporators.

* * * * *